US006953209B2

(12) United States Patent
Jackson, Jr. et al.

(10) Patent No.: US 6,953,209 B2
(45) Date of Patent: Oct. 11, 2005

(54) COMPRESSION LATCH

(75) Inventors: Joseph W. Jackson, Jr., Wilmington, DE (US); Gerard J. Clisham, West Chester, PA (US); Jeremy L. Godin, West Chester, PA (US); H. Allen Riblett, Ardentown, DE (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 10/254,368

(22) Filed: Sep. 24, 2002

(65) Prior Publication Data

US 2004/0056488 A1 Mar. 25, 2004

(51) Int. Cl.[7] ..... E05C 5/00

(52) U.S. Cl. ..... 292/66; 292/69; 292/100; 292/126; 292/200; 292/217; 292/336.3; 292/DIG. 31; 16/412

(58) Field of Search ..... 292/100, 113, 292/118, 126, 200, 217, 226, 229, 236, 66, DIG. 31, 137, 163, 170, 169.17, 207, 336.3; 16/412

(56) References Cited

U.S. PATENT DOCUMENTS 789,568 A * 5/1905 Roe et al. ..... 292/57
1,193,148 A * 8/1916 Hornung ..... 292/57
3,402,958 A * 9/1968 Barry ..... 292/62
4,556,244 A 12/1985 Bisbing
4,583,775 A 4/1986 Bisbing
4,706,478 A * 11/1987 Swan et al. ..... 70/28
4,763,935 A 8/1988 Bisbing
5,076,080 A * 12/1991 Fuss et al. ..... 70/125
D324,636 S 3/1992 Schlack et al.
5,409,272 A * 4/1995 McCormack ..... 292/66
D370,620 S 6/1996 Ziemer
5,526,660 A * 6/1996 Bennett et al. ..... 70/208
5,984,383 A * 11/1999 Parikh et al. ..... 292/121
6,224,118 B1 * 5/2001 Ashford ..... 292/202
6,418,761 B1 * 7/2002 Wytcherley et al. ..... 70/208
6,454,321 B1 * 9/2002 Parikh ..... 292/216
6,460,902 B1 * 10/2002 Kyle ..... 292/165
6,568,226 B1 * 5/2003 Ramsauer ..... 70/127
6,651,467 B1 * 11/2003 Weinerman et al. ..... 70/208

* cited by examiner

*Primary Examiner*—Daniel P. Stodola
*Assistant Examiner*—Carlos Lugo
(74) *Attorney, Agent, or Firm*—Paul & Paul

(57) ABSTRACT

A compression latch with a folding handle for selectively holding a door closed. The latch includes a housing with a cup portion for receiving the handle in the folded down position such that the projection of the latch handle above the exterior surface of the door is minimized in the folded-down position. The handle functions to move a pawl in a combination of rotational and linear translational movements as the pawl is moved between latched and unlatched positions.

28 Claims, 12 Drawing Sheets

COMPRESSION LATCH

BACKGROUND OF THE INVENTION

1. Field of Invention

The present invention relates to a compression latch for selectively maintaining a panel or door in a closed position relative to a doorframe or the like.

2. Brief Description of the Related Art

In many applications the need arises to selectively maintain a panel or door in a closed position relative to a doorframe or the like, while developing a compressive force between the door or panel and the doorframe. For example, when a gasket is used to provide a seal between a door and a doorframe when the door is closed, it would be desirable for the latch holding the door closed to provide a compressive force to compress the gasket between the door and the doorframe to effectively seal the any gap or seam between the door and doorframe. Latches that develop this type of compressive force between the door and doorframe are known as compression latches. An example of a known compression latch can be seen in U.S. Pat. No. 4,763,935, issued to Robert H. Bisbing on Aug. 16, 1988, the entire disclosure of which is incorporated herein by reference.

The compression latch of U.S. Pat. No. 4,763,935 does not provide for a handle that can be folded down in both the latched and unlatched configurations. In certain applications it is desirable to have a compression latch with a handle that can be folded down in both the latched and unlatched configurations so that a user's clothing or body parts will not catch on the handle even when the latch remains unlatched during intervals of time when it is more convenient to leave the latch in the unlatched configuration to allow repeated access through the door. An example of this type of application is a latch for the door of a holding tank for storing the catch in a sport fishing boat. The need persists in the art for a compression latch that has a handle that can be folded down to be practically flush with the exterior surface of the door in both the latched and unlatched configurations.

SUMMARY OF THE INVENTION

The present invention is directed to a compression latch with a folding handle for selectively holding a door closed. The latch includes a housing with a cup portion for receiving the handle in the folded down position such that the projection of the latch handle above the exterior surface of the door is minimized in the folded-down position. The handle functions to move a pawl in a combination of rotational and linear translational movements as the pawl is moved between latched and unlatched positions.

BRIEF DESCRIPTION OF THE DRAWINGS

Like reference numerals indicate like elements throughout the several views.

DETAILED DESCRIPTION OF THE INVENTION

Figure 1:
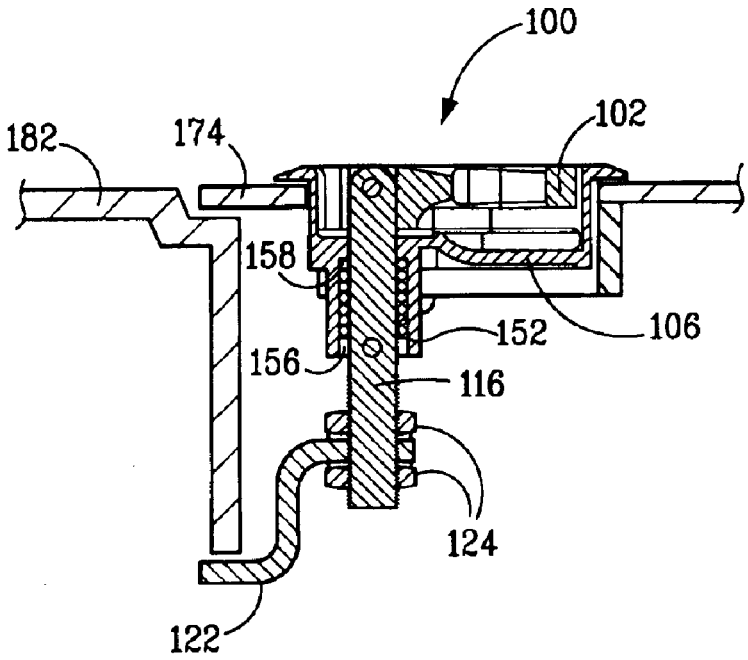
FIG. 1 is an environmental, cross sectional view showing the compression latch according to the present invention in the latched configuration.
Figure 2:
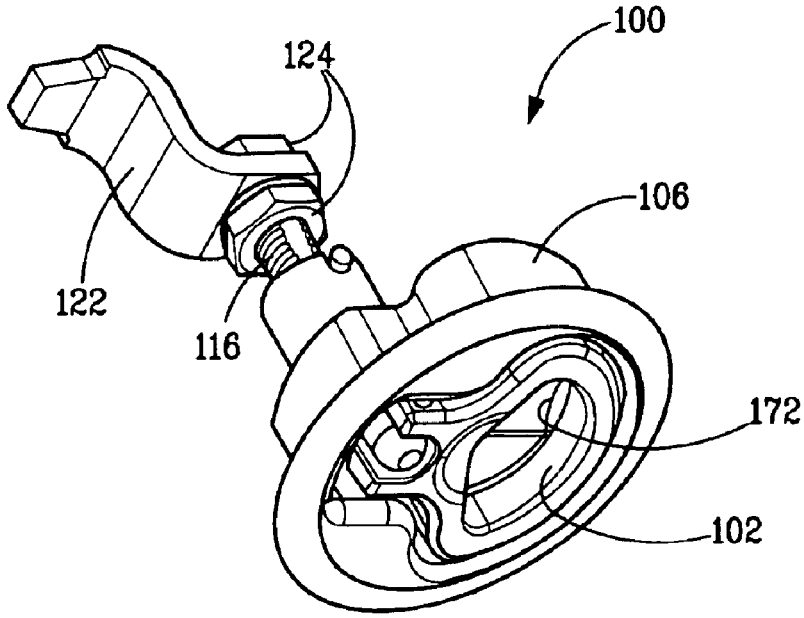
FIG. 2 is an isometric view showing the compression latch according to the present invention in the latched configuration.
Figure 3:
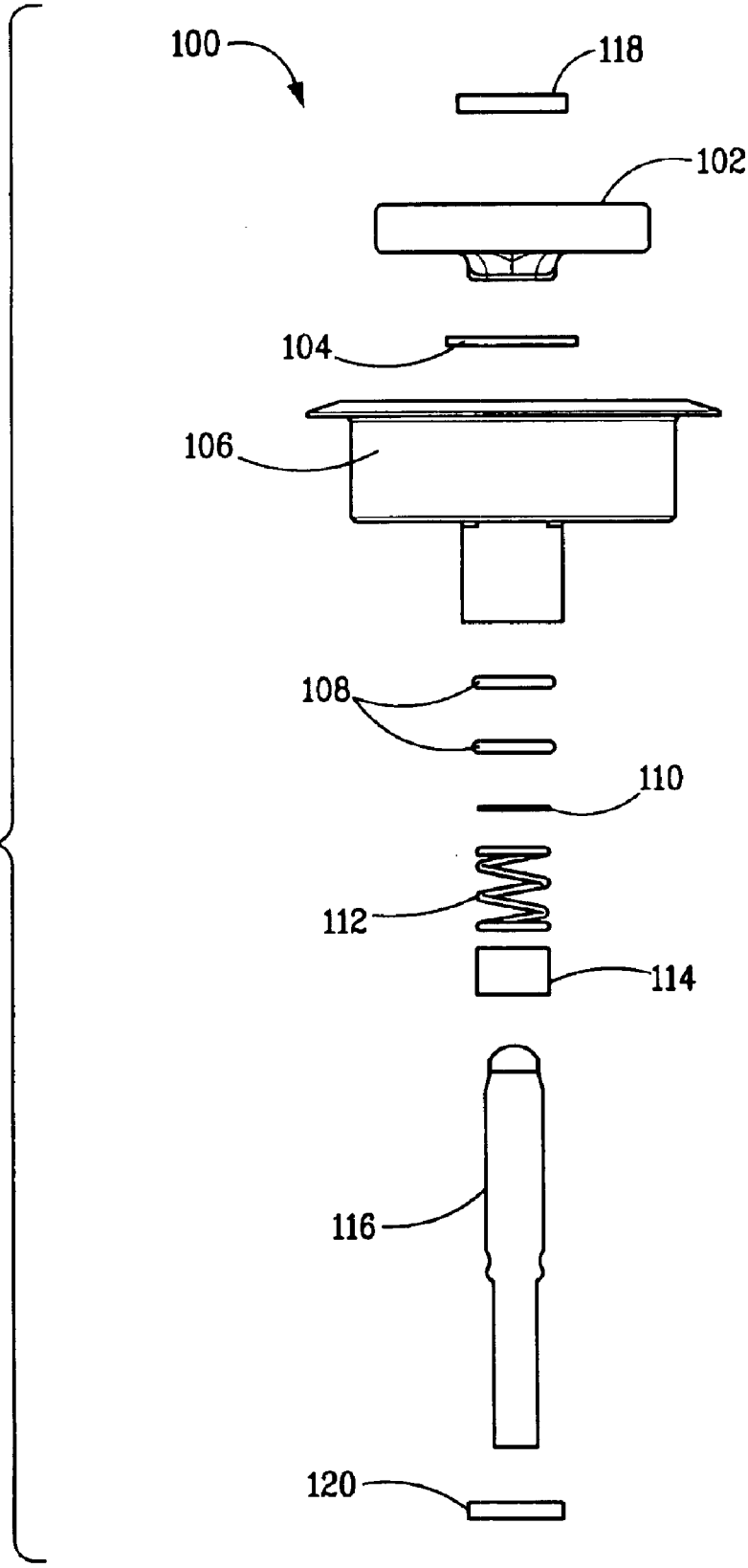
FIG. 3 is an exploded view showing the compression latch according to the present invention.
Figure 8:
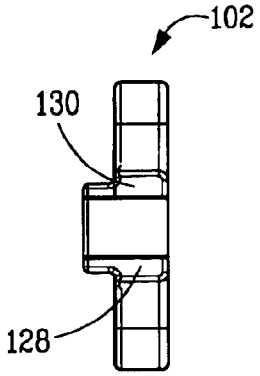
FIGS. 4–8 are views showing the handle of the compression latch according to the present invention.
Figure 4:
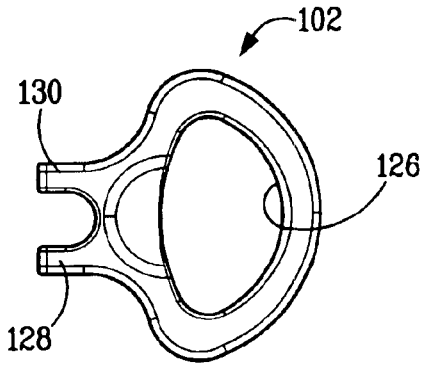
Figure 7:
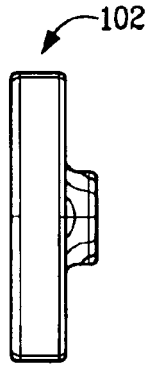
Figure 5:
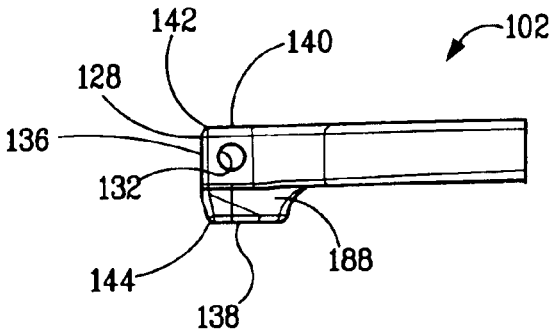
Figure 6:
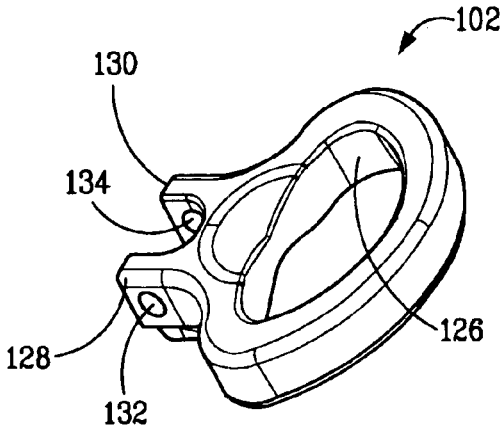
Figure 9:
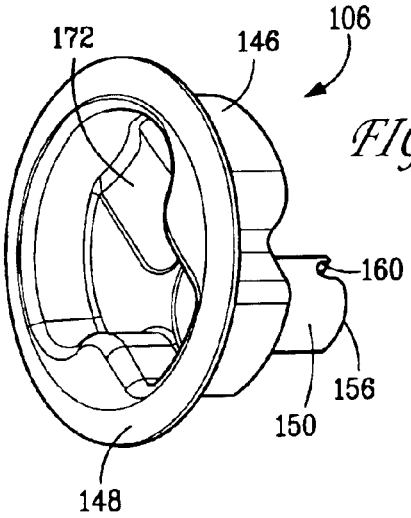
FIGS. 9–13 are views showing the housing of the compression latch according to the present invention.
Figure 10:
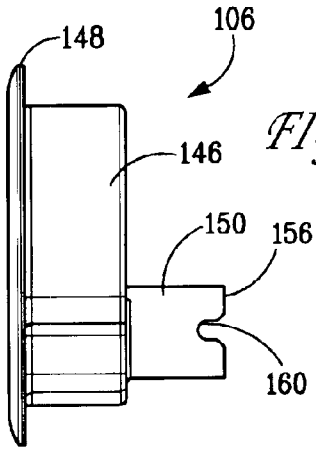
Figure 11:
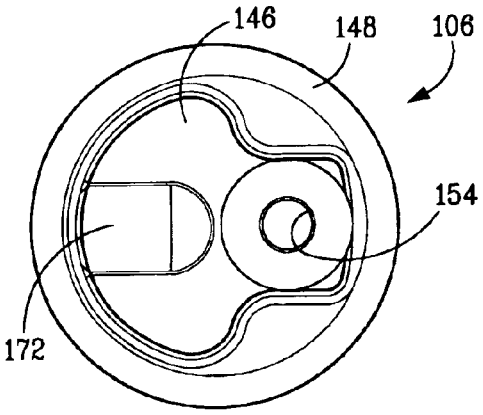
Figure 12:
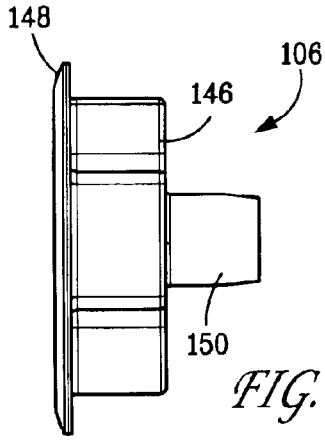
Figure 13:
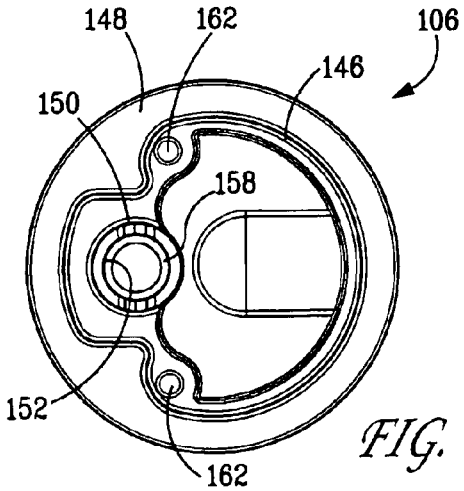
Figure 14:
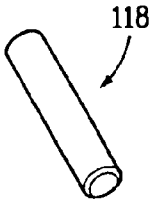
FIG. 14 is an isometric view of the handle pivot pin of the compression latch according to the present invention.
Figure 15:
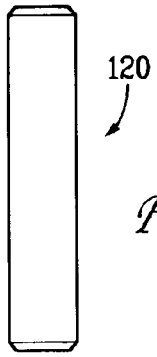
FIG. 15 is a side view of the retainer pin of the compression latch according to the present invention.

The present invention is directed to a latch for selectively maintaining a first member in a closed position relative to a second member. The first member, for example, may be a door and the second member, for example, may be a doorframe or a keeper attached to the doorframe. The latch of the present invention in general comprises a housing adapted for mounting to the first member; a pivotal handle supported relative to the housing such that the handle can be folded down relative to the housing; a pawl; and means for moving the pawl in a combination of rotational and linear translational movements responsive to at least some movements of the handle. The latch pawl is movable between a latched position and an unlatched position and the handle can be folded down when the rotational position of the pawl corresponds to both the latched and unlatched positions. By appropriate movement of the handle, the pawl can be rotated to bring the pawl into position behind a portion of the doorframe or a keeper. Further movement of the handle in a predetermined manner causes linear translation of the pawl toward the door, thus capturing the portion of the doorframe or the keeper between the pawl and the door to thereby apply a compressive force to a gasket or the like between the door and doorframe. With the latch in this configuration, the door is secured in the closed position with respect to the doorframe while any gap or crevice between the door and the doorframe is sealed by the compressive action of the latch.

The latch housing has a cup-like portion designed to receive at least a substantial enough portion of the latch handle when the latch handle is folded down such that there is a reduced chance of a users clothing or body parts catching on the handle. Preferably, at least a majority of the thickness of the handle is received within the cup-like portion of the housing when the latch handle is folded down. Even more preferably, substantially the entire thickness of the handle is received within the cup-like portion of the housing when the latch handle is folded down such that the projection of the latch handle above the exterior surface of the door is minimized in the folded-down position.

The latch housing is adapted to be mounted in an opening in the door such that the latch housing projects to only a small height above the exterior surface of the door when the latch housing is mounted in the door. This small height is equivalent to the thickness of a flange or bezel that surrounds the open top of the cup-like portion of the latch housing. Desirably, the latch handle is substantially flush with the flange or bezel of the cup-like portion of the latch housing when the latch handle is in the folded down position. In the latch of the present invention, the latch handle can be folded down to be substantially flush with the flange or bezel of the cup-like portion of the latch housing with the latch pawl is in both the latched and unlatched positions. The cup-like portion of the latch housing is sized and shaped to correspond at least with key portions of the outline of the latch handle in plan view such that the handle can only be folded down to be received in the cup-like portion when the pawl is in a rotational position corresponding to the latched and unlatched positions of the pawl. Any attempt to fold down the latch handle will fail when the pawl is not in a rotational position corresponding to the latched and unlatched positions of the pawl, because portions of the latch handle will be out of alignment with the open top of the cup-like portion of the latch housing and thus the latch handle cannot fold down into the cup-like portion of the latch housing.

Referring to FIGS. 1–41, an illustrative example 100 of a latch according to the present invention can be seen. The latch 100 includes a handle 102, a wear washer 104, a housing 106, a pair of o-rings 108, an o-ring washer 110, a coil spring 112, a collar 114, a shaft 116, a handle pivot pin 118, a retainer pin 120, a pawl 122, and pawl nuts 124. As best seen in FIGS. 4–8, the handle 102 is generally D-shaped and has an opening 126 that allows a user to insert a finger the opening in order to grasp the handle 102. The handle 102 is provided with a pair of extensions 128 and 130. Each of the extensions 128 and 130 has a hole, 132 and 134 respectively, that are in alignment with one another. The handle 102 has first, second, third, fourth, and fifth surface portions, 136, 138, 140, 142, and 144 respectively, whose functions will be described later.

As best seen in FIGS. 9–13, the latch housing 106 has a cup-like portion 146, a flange or bezel 148, and a sleeve portion 150. The sleeve portion 150 has a bore 152, a top opening 154, and a bottom opening 156. The top opening 154 has a smaller diameter than at least a portion of the bore 152. In the illustrated example, the bore 152 has a substantially uniform diameter and the bottom opening 156 is of essentially the same diameter as the bore 152. The transition between the diameter of the bore 152 and the diameter of the top opening 154 forms an annular shoulder 158 near the top opening 154 of the sleeve portion 150. The housing 106 has a pair of notches 160, near the bottom opening 156. The housing 106 has at least one threaded hole 162, and preferably a pair of threaded holes 162, that open to the bottom of the cup-like portion 146 of the housing 106. The housing 106 may also be provided with a finger groove 172 that provides enough clearance for a user's finger to reach under the handle 102 when it is folded down.

Figure 16:
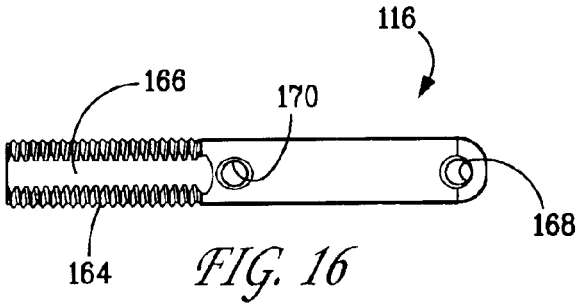
FIGS. 16–18 are views of the shaft of the compression latch according to the present invention.
Figure 17:
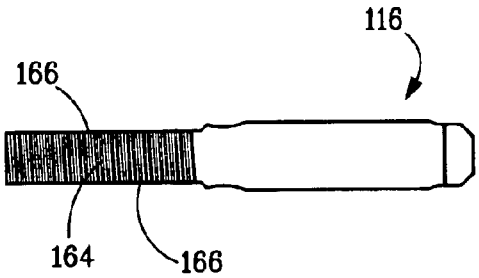
Figure 18:
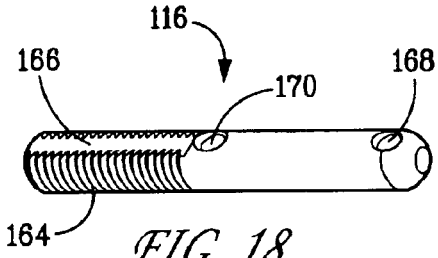
Figure 19:
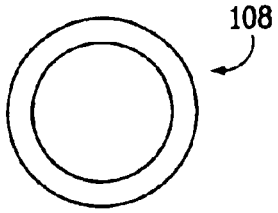
FIGS. 19–21 are views of the o-rings of the compression latch according to the present invention.
Figure 20:
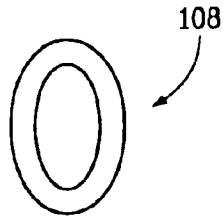
Figure 21:
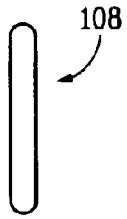
Figure 22:
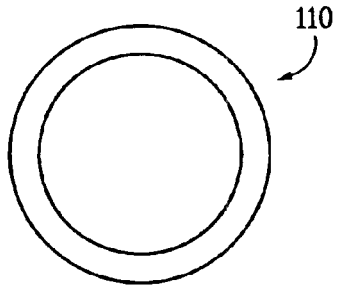
FIGS. 22–24 are views of the o-ring washer of the compression latch according to the present invention.
Figure 23:
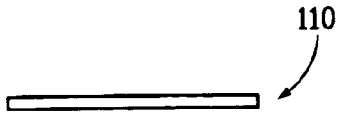
Figure 24:
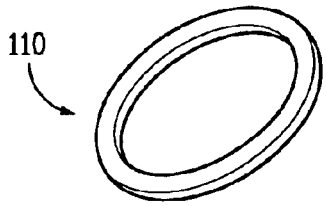
Figure 25:
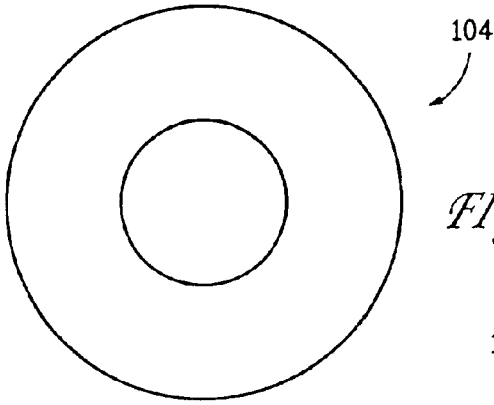
FIGS. 25–27 are views of the wear washer of the compression latch according to the present invention.
Figure 26:
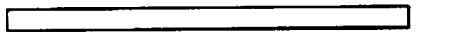
Figure 27:
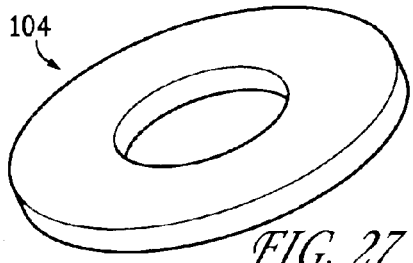
Figure 28:
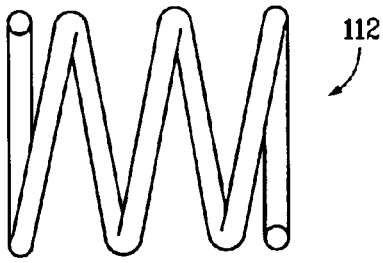
FIGS. 28–30 are views of the coil spring of the compression latch according to the present invention.
Figure 29:
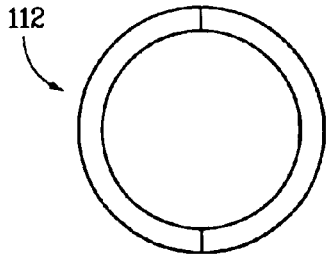
Figure 30:
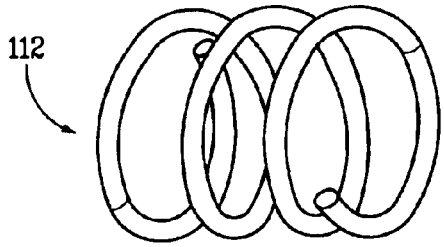
Figure 31:
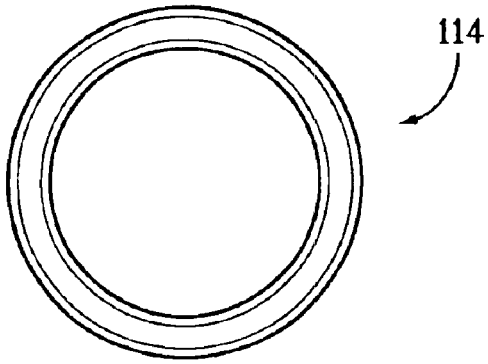
FIGS. 31–33 are views of the collar of the compression latch according to the present invention.
Figure 32:
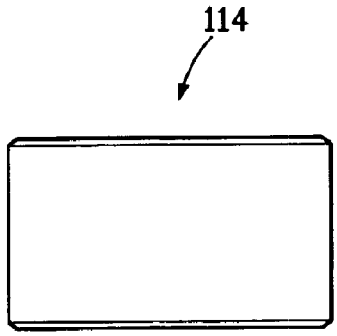
Figure 33:
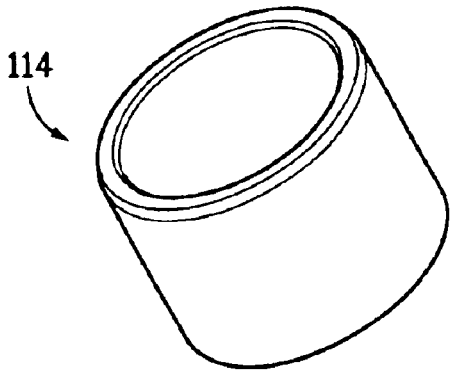

As best seen in FIGS. 16–18, the shaft 116 has a portion 164 that has threads that are interrupted by flat sides 166 on either side of the threaded portion 164. The shaft 116 is provided with a first hole 168 that passes through the shaft, transverse to the longitudinal axis of the shaft, at a location near the top end of the shaft. The shaft 116 is provided with a second hole 170 that passes through the shaft, transverse to the longitudinal axis of the shaft, at a location near the top end of the threaded portion 164 of the shaft 116.

The shaft 116 is positioned at least in part within the bore 152 of the sleeve portion 150. The shaft 116 extends through the top opening 154 of the sleeve portion 150 such that the top end portion of the shaft 116 is located in the cup-like portion 146 of housing 106. The top end portion of the shaft 116 located in the cup-like portion 146 of housing 106 is received between the pair of extensions 128 and 130 such that the holes 132 and 134 are in registry with the hole 168 of the shaft 116. The pin 118 passes through the holes 132 and 134 of the pair of extensions 128 and 130 and the hole 168 in the top end portion of the shaft 116 to pivotally connect the handle 102 to the shaft 116. Optionally, the shaft 116 may pass through a wear washer 104 that is positioned intermediate the handle 102 and the bottom of the cup-like portion 146 of the housing 106. The wear washer 104 reduces the wear on the housing 106 by providing a bearing surface against which the surface portions 136, 138, 140, 142, and 144 of the handle 102 can bear as the handle 102 is alternately folded and raised. Thus, the wear washer 104 allows the housing 106 to be manufactured from less expensive materials. However, it is also possible for the surface portions 136, 138, 140, 142, and 144 of the handle 102 to bear directly against the bottom of the cup-like portion 146 of the housing 106 while still allowing the latch 100 to function as intended.

The two o-rings 108 are positioned in tandem in the bore 152 such that the o-rings surround the shaft 116 and the top o-ring bears against the shoulder 158. The o-ring washer 110 is positioned in the bore 152 adjacent the lower o-ring and also surrounds the shaft 116. The o-ring washer 110 provides a protective surface for one end of the spring 112 to bear against while reducing wear to the o-rings 108. The spring 112 is also positioned within the bore 152 of the sleeve portion of the housing 106 and its coils surround the shaft 116. The collar 114 is positioned adjacent the lower end of the spring 112, encircles the shaft 116, and lies at least in part within the bore 152 of the sleeve portion of the housing 106. The ends of the pin 120 project outward from the shaft 116. The collar 114 is captured between the pin 120 and the lower end of the spring 112. The pin 120 keeps the assembled latch from falling apart. The spring 112 is under compression and acts as a biasing means tending to bias the threaded portion 164 of the shaft 116 away from housing 106. The biasing force of the spring 112 is applied to the shaft 116 via the collar 114 and the pin 120. The o-rings 108 seal any crevices between the shaft 116 and the top opening 154 of the sleeve portion of the housing 106. This feature is particularly desirable when the latch 100 is to be used for marine applications and passage of salt water through the latch is to be avoided. As an alternative, the collar 114 may have holes that are in registry with the hole 170, thus allowing the shaft 120 to pass through both the collar 114 and the shaft 116.

Figure 34:
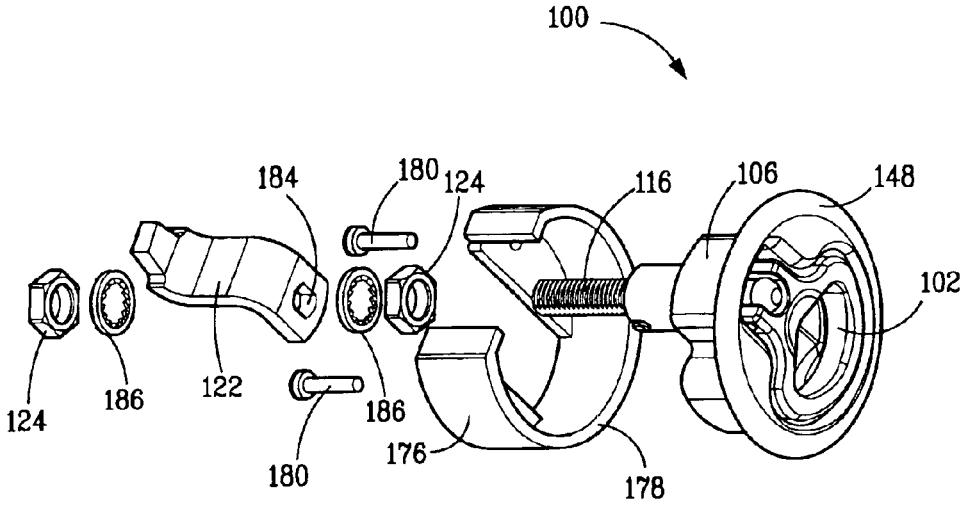
FIG. 34 is an exploded view showing the mounting hardware and pawl of the compression latch according to the present invention.
Figure 35:
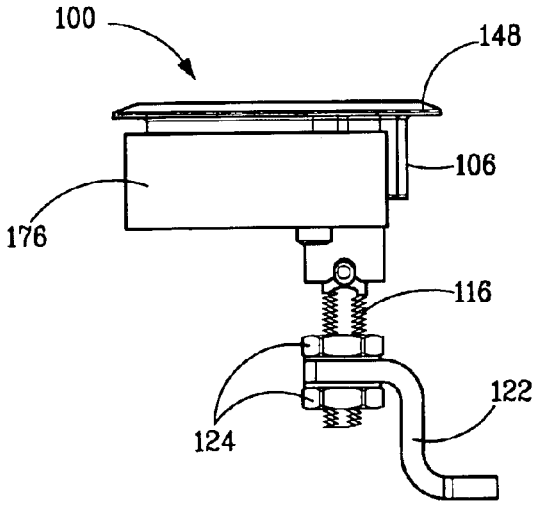
FIG. 35 is a side view showing the mounting hardware and pawl of the compression latch according to the present invention with the latch in the latched configuration.
Figure 36:
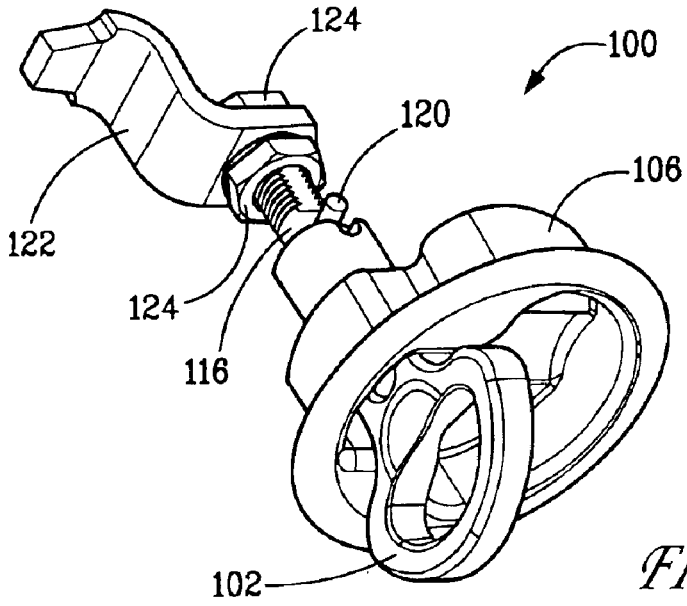
FIG. 36 is an isometric view showing the compression latch according to the present invention with the handle raised to allow the pawl to translate linearly away from the latch housing.
Figure 37:
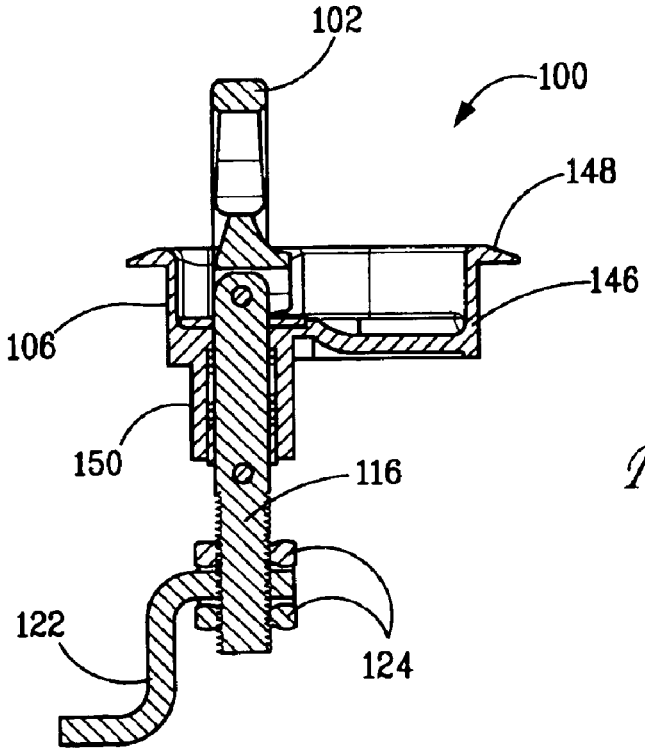
FIG. 37 is a cross sectional view showing the compression latch according to the present invention with the handle raised to allow the pawl to translate linearly away from the latch housing.
Figure 38:
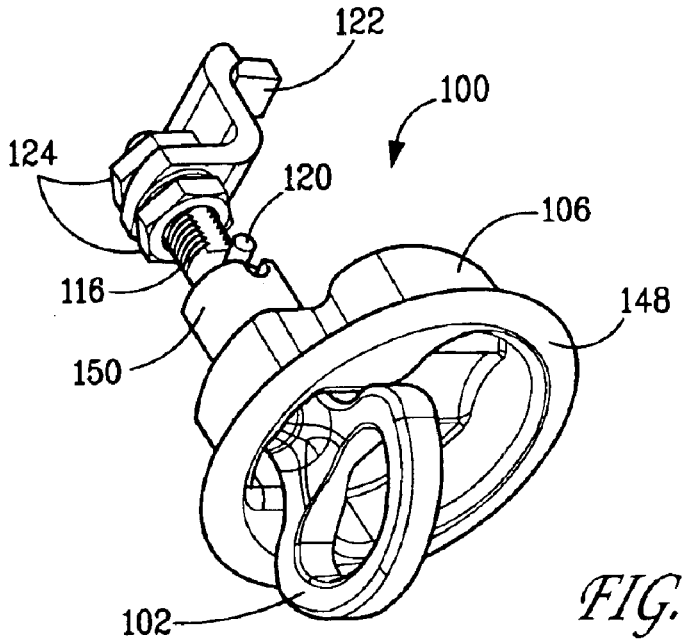
FIG. 38 is an isometric view showing the compression latch according to the present invention with the handle raised and with the pawl in the unlatched position.
Figure 39:
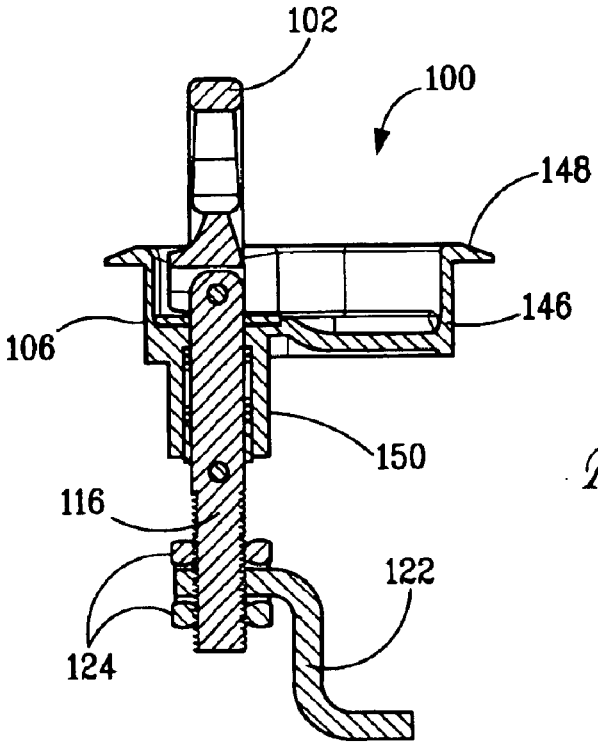
FIG. 39 is a cross sectional view showing the compression latch according to the present invention with the handle raised and with the pawl in the unlatched position.
Figure 40:
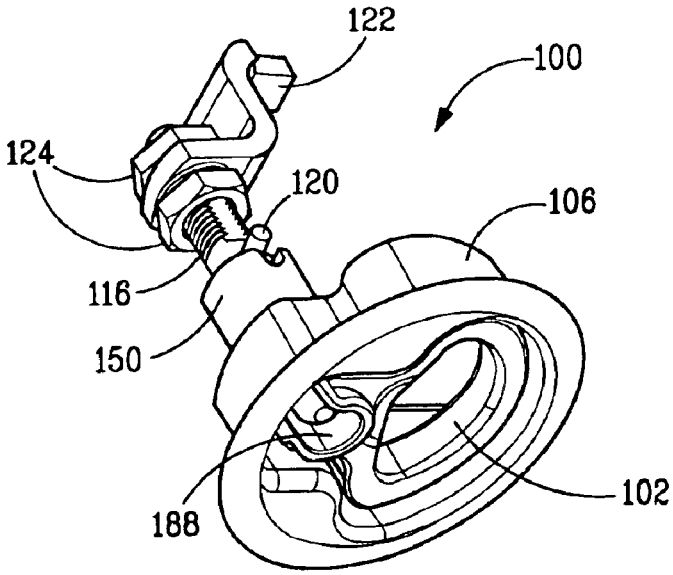
FIG. 40 is an isometric view showing the compression latch according to the present invention with the handle folded down and with the pawl in the unlatched position.

Referring to FIGS. 1, 34 and 35, the latch 100 is mounted to an opening or hole in the door 174. The opening in the door 174 is shaped and sized to provide clearance for the side walls of the cup-like portion 146 of the housing 106 but not for the flange 148. To mount the latch 100 to the door 174, the cup-like portion 146 of the housing 106 is placed through the opening in the door 174 such that the underside of the flange 148 abuts the exterior surface of the door 174. A bracket 176 is placed over the cup-like portion 146 of the housing 106 such that the surface of the rim 178 of the bracket 176 abuts the interior surface of the door 174. The dimension of the bracket 176 measured across the rim 178 is too large to clear the opening in the door 174. A pair of fasteners 180 is used to secure the bracket 176 to the housing 106. Thus, at least a portion of the door 174 is captured intermediate the flange 148 and the bracket 176 to secure the latch 100 to the door 174. An optional gasket may be provided between the flange 148 and the exterior surface of the door 174 to seal off any crevices between the housing 106 and the door 174 in applications where leak-proofing the latch is important.

The pawl 122 has one end that is adapted for engaging the door frame 182, or a keeper, when the pawl 122 is in the latching configuration shown in FIG. 1. The pawl 122 has a hole 184 through the end opposite the end adapted to engage the doorframe 182. The hole 184 is shaped to correspond to the cross section of the threaded portion 164 of the shaft 116 and has flat sides that engage the flat sides 166 of the threaded portion of the shaft 116 such that the shaft 116 and the pawl 122 rotate together as a unit about the longitudinal axis of the shaft 116 when the threaded portion of the shaft 116 is placed through the hole 184 of the pawl 122. The pawl 122 is adjustably secured in position along the threaded portion 164 of the shaft 116 by a pair of nuts 124. The nuts 124 are engaged to the threaded portion of the shaft 116 and tightened against the pawl 122 to secure the pawl 122 in place once the pawl is mounted on the threaded portion of the shaft 116. Lock washers 186 can be provided intermediate the pawl 122 and the nuts 124 to reduce the chance of the nuts 124 becoming loose during operation and use of the latch 100.

Figure 41:
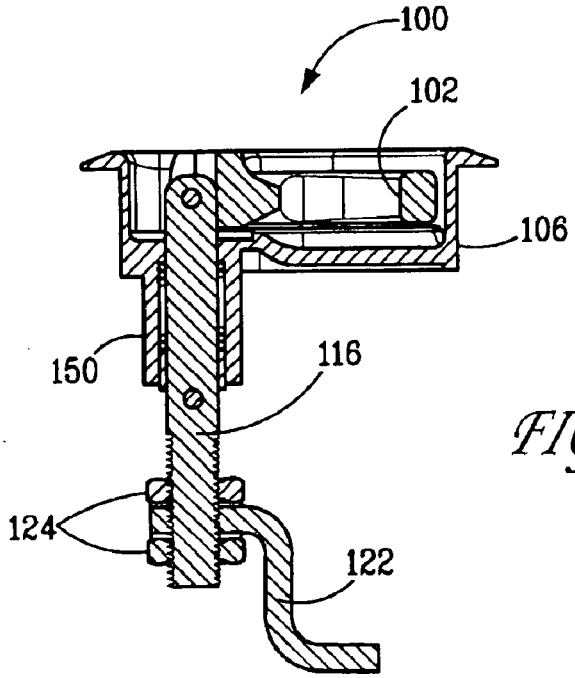
FIG. 41 is a cross sectional view showing the compression latch according to the present invention with the handle folded down and with the pawl in the unlatched position.

The handle 102 can be moved pivotally between an extended configuration (shown in FIGS. 37 and 39) and one of a first folded-down configuration (shown in FIG. 1) and a second folded-down configuration (shown in FIG. 41). The latch 100 secures the door 174 in a closed position against the doorframe 182 when the latch 100 is mounted to the door 174 and the pawl 122 is in the latched position such that it engages the doorframe 182 as shown in FIG. 1. With the latch in the latched configuration of FIG. 1, the handle 102 can be folded down to the first folded-down configuration as shown in FIG. 1.

The pivot pin 118 defines a pivot axis for the handle 102 that is orthogonal to the longitudinal axis of the shaft 116. With the handle 102 in the configuration shown in FIG. 1, the pawl 122 is in the latched position and the handle 102 is in the first folded-down configuration. Also, with the handle 102 is in the first folded-down configuration, the surface portion 138 is positioned between the pivot axis of the handle 102 and a bearing surface at the bottom of the cup-like portion of the housing 106. The bearing surface can be provided either by the bottom of the cup-like portion of the housing or by the wear washer 104. When the handle 102 is moved to the extended configuration of FIGS. 37 and 39, the surface portion 136 becomes positioned between the pivot axis of the handle 102 and the bearing surface at the bottom of the cup-like portion of the housing 106. The result of moving the handle 102 from the first folded-down configuration to the extended configuration is that the pawl linearly translates away from the housing 106 to thereby release the compressive force being exerted between the door 174 and the door frame 182, because the surface portion 136 is closer to the pivot axis of the handle than the surface portion 138. Now the handle 102 can be rotated about the longitudinal axis of the shaft 116 to rotate the shaft 116 and thereby rotate the pawl 122 out from behind the doorframe 182. Usually a rotation of 90° or less is sufficient to rotate the pawl 122 out from behind the doorframe 182 and allow opening of the door 174. However in the illustrated embodiment the handle 102 must be turned substantially 180° before the handle 102 can be folded down into the cup-like portion 146 with the pawl 122 in the unlatched position. The handle 102 will be, in the second folded-down configuration of FIG. 41 when it is folded down into the cup-like portion 146 with the pawl 122 in the unlatched position. In the second folded-down configuration, the surface portion 140 becomes positioned between the pivot axis of the handle 102 and the bearing surface at the bottom of the cup-like portion of the housing 106. The pawl and shaft will not linearly translate as a result, because the distance between the pivot axis of the handle 102 and the surface portion 140 is not appreciably different from the distance between the pivot axis of the handle 102 and the surface portion 136. The pawl 122 will now be maintained in the unlatched position because the walls of the cup-like portion of the housing 106 prevent rotation of the handle 102 about the longitudinal axis of the shaft 116.

To once again latch the door 174, the handle is lifted from the second folded-down configuration to the extended configuration. The handle 102 can is then rotated about the longitudinal axis of the shaft 116 to rotate the pawl 122 into position behind the doorframe 182. The handle 102 is then folded down from the extended configuration to the first folded-down configuration to cause the pawl 122 to linearly translate toward the housing 106 and to thereby squeeze the door 174 and the door frame 182 together in a secured relationship. The pawl 122 will now be maintained in the latched position because the walls of the cup-like portion of the housing 106 prevent rotation of the handle 102 about the longitudinal axis of the shaft 116. Although in the illustrated example the handle must be turned 180° to allow the handle to be folded down with the pawl unlatched, it is possible to arrange for the handle to be folded down at any angle, so long as the pawl is unlatched, by appropriate selection of the geometry of the cup-like portion of the housing 106 and the handle 102.

The surface portions 142 and 144 are positioned farther from the pivot axis of the handle 102 as compared to surface portions 140 and 138, respectively, such that the resistance of the spring 112 provides a detent action to deter uncontrolled movement of the handle between folded and extended configurations. In the illustrated embodiment the surface portions 136, 138, 140, 142, and 144 are integral with the handle 102.

The sleeve portion of the housing 106 may be provided with notches 160 that receive the ends of the pin 120 in the latched configuration for further strength and security. In the illustrated embodiment, the surface portion 138 is provided by a raised boss 188 that provides a visual and tactile indication of the unlatched state of the latch 100. It is also possible to provide other or additional alphanumeric or iconographic indicia to indicate the state of the latch 100 to a user.

It is to be understood that the present invention is not limited to the embodiments described above, but includes any and all embodiments within the scope of the appended claims. Furthermore, it is to be understood that the embodiments of the present invention disclosed above are susceptible to various modifications, changes and adaptations by those skilled in the art, without departing from the spirit and scope of the invention.

What is claimed is:

1. A latch for selectively maintaining a first member in a closed position relative to a second member, the latch comprising:

a housing adapted for mounting to the first member, wherein said housing has a cup-like portion;

a pivotal handle supported relative to said housing such that said handle can be folded down relative to said housing, said handle being pivotally movable between an extended configuration and one of a first folded-down configuration and a second folded-down configuration;

a pawl; and means for moving said pawl in a combination of rotational and linear translational movements responsive to at least some movements of said handle, wherein said pawl is movable between a latched position and an unlatched position and said handle can be folded down when said pawl is in both said latched and unlatched positions, wherein said handle is substantially received in said cup-like portion when said handle is folded down to be in said first folded-down configuration and when said handle is folded down to be in said second folded-down configuration, wherein said pawl is in said latched position when said handle is in said first folded-down configuration, and wherein said pawl linearly translates away from said housing as said handle is pivotally moved from said first folded-down configuration to said extended configuration.

2. The latch according to claim 1, wherein said handle is rotated through about 180° in said extended configuration during movement of said pawl between said latched and unlatched positions.

3. The latch according to claim 1, wherein said pawl substantially remains in said unlatched position as said handle is pivotally moved from said extended configuration to said second folded-down configuration.

4. The latch according to claim 1, wherein said means for moving said pawl in a combination of rotational and linear translational movements comprises:

a shaft supported for rotational and linear translational movements relative to said housing, said pawl being supported at least in part by said shaft such that said shaft and said pawl move together as a unit when said latch is operated by a user to latch or unlatch the first member relative to the second member;

biasing means acting on said shaft to bias said pawl in a direction away from said housing when said pawl is secured on said shaft;

pivotal attachment means attaching said handle to said shaft and defining a pivot axis for said handle;

a first surface portion disposed to move as a unit with said handle, said first surface portion abutting a bearing surface supported by said housing when said handle is in said extended configuration; and a second surface portion disposed to move as a unit with said handle, said second surface portion abutting said bearing surface when said handle is in said first folded-down configuration, Wherein said pivot axis is farther from said bearing surface when said handle is in said first folded-down configuration than when said handle is in said extended configuration, such that movement of said handle from said first folded-down configuration to said extended configuration allows said pawl to linearly translate away from said housing under the influence of said biasing means.

5. The latch according to claim 4, wherein said shaft has a longitudinal axis, wherein said pivot axis extends in a direction that is substantially orthogonal to said longitudinal axis of said shaft, and wherein rotation of said handle about said longitudinal axis of said shaft causes rotational movement of said pawl at least when said handle is in said extended configuration.

6. The latch according to claim 5, wherein said cup-like portion of said housing interferes with rotation of said handle about said longitudinal axis of said shaft to thereby substantially prevent rotational movement of said pawl when said handle is in one of said first and second folded-down configurations.

7. The latch according to claim 4, further comprising:

a third surface portion disposed to move as a unit with said handle, said third surface portion abutting said bearing surface when said handle is in said second folded-down configuration, Wherein said pivot axis is substantially the same distance from said bearing surface when said handle is in said second folded-down configuration as when said handle is in said extended configuration.

8. The latch according to claim 7, further comprising:

a fourth surface portion disposed to move as a unit with said handle, said fourth surface portion abutting said bearing surface at least as said handle is moved between said second folded-down configuration and said extended configuration, Wherein said pivot axis is moved farther from said bearing surface, as compared to when said handle is in one of said second folded-down configuration and said extended configuration, when said fourth surface portion abuts said bearing surface and is positioned along a line passing through said pivot axis and being parallel with said longitudinal axis of said shaft to thereby provide a detent to deter uncontrolled movement of said handle between said second folded-down configuration and said extended configuration.

9. The latch according to claim 8, wherein said first, second, third, and fourth surface portions are integral with said handle.

10. The latch according to claim 4, wherein said housing has a pair of notches, the latch further comprising a first pin passing through said shaft with at least one end of said first pin projecting from said shaft, said one end of said first pin moving into said notches as said handle is moved from said extended configuration to said first folded-down configuration.

11. The latch according to claim 4, wherein said biasing means is a coil spring, the latch further comprising a first pin passing through said shaft, said coil spring being captured intermediate said first pin and at least a portion of said housing.

12. The latch according to claim 11, wherein said housing further includes a sleeve portion attached to the bottom of said cup-like portion, said sleeve portion has a bore, a top opening, and a bottom opening, said top opening has a smaller diameter than at least a portion of said bore, said coil spring is captured intermediate said first pin and said top opening of said sleeve portion, and said shaft extends through said top opening such that a portion of said shaft is positioned in said cup-like portion.

13. The latch according to claim 12, wherein said handle is generally D-shaped and is provided with a pair of extensions, an end of said shaft located in said cup-like portion is received between said pair of extensions, and a second pin passes through said pair of extensions and said end of said shaft located in said cup-like portion to pivotally connect said handle to said shaft.

14. The latch according to claim 13, wherein said housing further includes a flange surrounding the open top of said cup-like portion and at least one threaded hole, the latch further comprising a bracket and a fastener for securing said bracket to said housing, Wherein a portion of the first member is captured intermediate said flange and said bracket to secure the latch to the first member.

15. The latch according to claim 14, wherein said shaft has a portion that has threads that are interrupted by at least one flat side, said pawl has a correspondingly shaped hole through which said portion of said shaft having interrupted threads passes, and said pawl is secured in place along said portion of said shaft having interrupted threads by a pair of nuts engaging said portion of said shaft having interrupted threads on either side of said pawl, whereby said pawl is adjustably positioned along said portion of said shaft having interrupted threads.

16. The latch according to claim 4, wherein said cup-like portion of said housing is sized and shaped such that said handle can only be folded down to be substantially received in said cup-like portion when said pawl is in a rotational position corresponding to said latched position and in a rotational position corresponding to said unlatched position.

17. The latch according to claim 6, further comprising:

a third surface portion disposed to move as a unit with said handle, said third surface portion abutting said bearing surface when said handle is in said second folded-down configuration, Wherein said pivot axis is substantially the same distance from said bearing surface when said handle is in said second folded-down configuration as when said handle is in said extended configuration.

18. The latch according to claim 17, further comprising:

a fourth surface portion disposed to move as a unit with said handle, said fourth surface portion abutting said bearing surface at least as said handle is moved between said second folded-down configuration and said extended configuration, Wherein said pivot axis is moved farther from said bearing surface, as compared to when said handle is in one of said second folded-down configuration and said extended configuration, when said fourth surface portion abuts said bearing surface and is positioned along a line passing through said pivot axis and being parallel with said longitudinal axis of said shaft to thereby provide a detent to deter uncontrolled movement of said handle between said second folded-down configuration and said extended configuration.

19. The latch according to claim 18, wherein said first, second, third, and fourth surface portions are integral with said handle.

20. The latch according to claim 19, wherein said housing has a pair of notches, the latch further comprising a first pin passing through said shaft with at least one end of said first pin projecting from said shaft, said one end of said first pin moving into said notches as said handle is moved from said extended configuration to said first folded-down configuration.

21. The latch according to claim 20, wherein said biasing means is a coil spring, the latch further comprising a first pin passing through said shaft, said coil spring being captured intermediate said first pin and at least a portion of said housing.

22. The latch according to claim 21, wherein said housing further includes a sleeve portion attached to the bottom of said cup-like portion, said sleeve portion has a bore, a top opening, and a bottom opening, said top opening has a smaller diameter than at least a portion of said bore, said coil spring is captured intermediate said first pin and said top opening of said sleeve portion, and said shaft extends through said top opening such that a portion of said shaft is positioned in said cup-like portion.

23. The latch according to claim 22, wherein said handle is generally D-shaped and is provided with a pair of extensions, an end of said shaft located in said cup-like portion is received between said pair of extensions, and a second pin passes through said pair of extensions and said end of said shaft located in said cup-like portion to pivotally connect said handle to said shaft.

24. The latch according to claim 23, wherein said housing further includes a flange surrounding the open top of said cup-like portion and at least one threaded hole, the latch further comprising a bracket and a fastener for securing said bracket to said housing, Wherein a portion of the first member is captured intermediate said flange and said bracket to secure the latch to the first member.

25. The latch according to claim 24, wherein said shaft has a portion that has threads that are interrupted by at least one flat side, said pawl has a correspondingly shaped hole through which said portion of said shaft having interrupted threads passes, and said pawl is secured in place along said portion of said shaft having interrupted threads by a pair of nuts engaging said portion of said shaft having interrupted threads on either side of said pawl, whereby said pawl is adjustably positioned along said portion of said shaft having interrupted threads.

26. The latch according to claim 25, wherein said cup-like portion of said housing is sized and shaped such that said handle can only be folded down to be substantially received in said cup-like portion when said pawl is in a rotational position corresponding to said latched position and in a rotational position corresponding to said unlatched position.

27. The latch according to claim 1, wherein said cup-like portion of said housing is sized and shaped such that said handle can only be folded down to be substantially received in said cup-like portion when said pawl is in a rotational position corresponding to said latched position and in a rotational position corresponding to said unlatched position.

28. The latch according to claim 27, wherein said pawl is rotated through about 180° as said pawl moves between said rotational position corresponding to said latched position and said rotational position corresponding to said unlatched position.

* * * * *